US005209533A

United States Patent [19]

Menard

[11] Patent Number: 5,209,533

[45] Date of Patent: May 11, 1993

[54] REFRIGERATOR DOOR GUARD

[76] Inventor: Louise G. Menard, 1936 Thomas St., Hollywood, Fla. 33020

[21] Appl. No.: 536,424

[22] Filed: Jun. 12, 1990

[51] Int. Cl.[5] ..... E05C 17/54

[52] U.S. Cl. ..... 292/288; 292/DIG. 71; 292/258

[58] Field of Search ..... 292/258, 259, 262, 288, 292/DIG. 71

[56] References Cited

U.S. PATENT DOCUMENTS

| | | | |
|---|---|---|---|
| 684,253 | 10/1901 | Houston | 292/256 |
| 1,002,013 | 8/1911 | Urban | 292/288 |
| 1,719,343 | 7/1929 | Strayer | 292/288 X |
| 2,003,856 | 6/1935 | Gimbel | 292/288 |
| 2,524,940 | 10/1950 | Surridge | 292/288 |
| 2,608,711 | 9/1952 | Moore | 292/288 X |
| 2,904,986 | 9/1959 | Anderson | 70/101 X |
| 2,924,476 | 2/1960 | Deane | 292/288 X |
| 3,797,871 | 3/1974 | Morishita | 292/DIG. 65 |
| 3,893,725 | 7/1975 | Coulter et al. | 292/258 |
| 4,330,147 | 5/1982 | Nolen | 292/259 R |

*Primary Examiner*—Richard E. Moore

*Attorney, Agent, or Firm*—Malin, Haley, DiMaggio & Crosby

[57] ABSTRACT

A door guard for preventing a child from opening a refrigerator door while not reducing adult access to the refrigerator comprising an elongated rigid bar having flanges at each end, the bar being sized in length to fit between the back wall of the refrigerator and the front wall of the door of the refrigerator in the locked position. The bar is mounted on top of the refrigerator and prevents access from a small child while still allowing an adult to quickly raise the bar in order to open the refrigerator door. The device prevents a child from inadvertently leaving the refrigerator door open for long, unattended periods which could cause damage to the refrigerator compressor motor while also preventing a child from having access to the interior of the refrigerator.

5 Claims, 2 Drawing Sheets

REFRIGERATOR DOOR GUARD

BACKGROUND OF THE INVENTION

1. Field of the Invention

A door guard for a refrigerator to prevent a child from opening the refrigerator door while at the same time not impeding adult access to the refrigerator.

2. Description of Prior Art

Refrigerator doors, when closed and sealed, generally run the full length of the refrigerator from top to the bottom near the floor. Because the doors are not latched and are disposed close to the floor, a small child can easily open a refrigerator door and most often leave the door ajar after the child leaves the refrigerator area. Leaving a refrigerator door open for long and unnecessary periods of time wastes electricity and causes the refrigerator compressor to work harder, often resulting in damage to the compressor motor. Refrigerator door locks that have been used are cumbersome and hamper or impede convenient adult access to the refrigerator door.

The present invention overcomes these problems by providing a very non-complex refrigerator door guard that prevents a child from opening a refrigerator door while at the same time permiting easy adult access.

SUMMARY OF THE INVENTION

A refrigerator door guard comprising an elongated bar having a pair of substantially ninety degree flanges at each end, the bar being sized in length from flange to flange to reach from the uppermost door corner of the refrigerator, across the top of the refrigerator and engage the rear top corner of the refrigerator to prevent the door from being opened. The bar may include a padded section on the inside wall of each of the flanges and at predetermined locations along the length of the bar to prevent damage to the surface of the refrigerator.

The bar may also be divided into two separate sections that are longitudinally engaged to provide adjustment in length with a nut and bolt locking device so that a standard refrigerator guard can be made to accomodate various size refrigerators.

The bar may further include one or more magnets so that it cannot slide while mounted on the refrigerator.

Further, the bar may be coated with TEFLON (T.M. polymerized tetra-fluoroethylene) or another smooth material again to prevent damage to the finish of the refrigerator.

In operation, the length of the bar is adjusted so that each of the end flanges fits firmly downwardly over the upper front and rear corners of the refrigerator from front to back engaging the door and the rear back side of the refrigerator. Once the size has been determined and adjusted the bar can then be conveniently placed on top of the refrigerator whereby the flanges at both ends are engaged so that the door cannot be opened.

For use with a double door refrigerator wherein there is an upper and lower door, the bar can be positioned near the top of the lower door above the lower door handle so that it is supported partially on the lower door handle and again adjusted in length to firmly fit from the back of the refrigerator wall and corner edge to the front surface of the lower refrigerator door.

An adult desiring access to the refrigerator need merely lift the bar, disengaging the end flange and resting the bar on the top of the refrigerator to permit access and use of the refrigerator. On closing the door the bar is merely repositioned with the flange engaging the front door.

In an alternate embodiment, the bar could be replaced by a strong flexible strap that includes fabric fasteners (Velcro) or magnets at each end anchored to the refrigerator top surface and the door.

It is an object of this invention to provide a non-complex refrigerator door guard to prevent small children from opening the refrigerator door.

It is another object of this invention to provide a door guard that will prevent the refrigerator door from being inadvertently left open by small children by preventing access to the refrigerator by children.

In accordance with these and other objects which will be apparent hereinafter, the instant invention will now be described with particular reference to the accompanying drawings.

PREFERRED EMBODIMENT OF THE INVENTION

Figure 1:
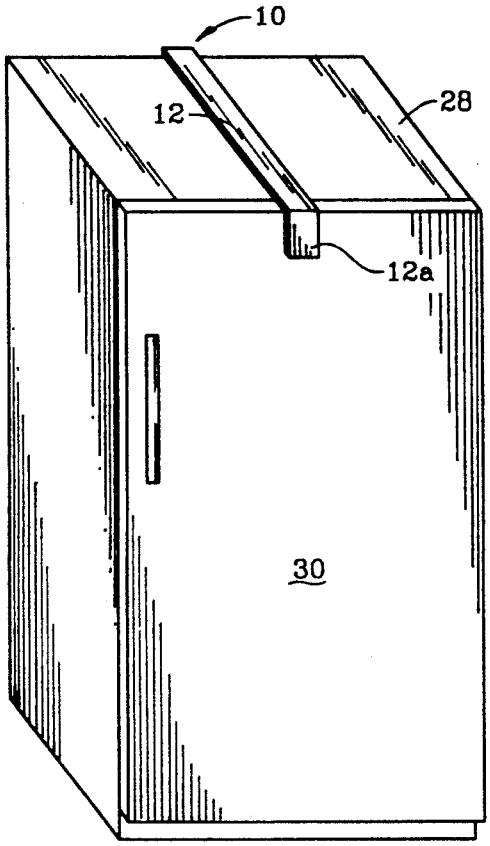
FIG. 1 shows a perspective view of the invention installed on a conventional refrigerator.

Referring now to the drawings and especially FIG. 1, the present invention is shown generally at 10 comprised of an elongated bar 12 substantially rectangular in cross section including a flange **12*a* at one end which is disposed over the top corner of door 30 of refrigerator 28. At the opposite end of bar 12 is another identical flange 12*b* (FIG. 3) as shown. In this embodiment the bar is shown as a unitary member so that the flanges 12*a* and 12*b* firmly secure the refrigerator door 30** in a closed position preventing a small child from reaching the bar along the top of the refrigerator.

Figure 2:
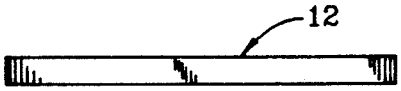
FIG. 2 shows a top plan view of the invention.
Figure 3:
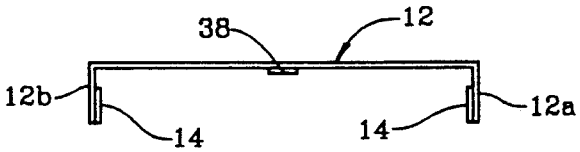
FIG. 3 shows a side elevational view of the invention.

FIGS. 2 and 3 show the length of the bar 12 which is sized to fit firmly across the top of a conventional refrigerator. In FIG. 3, pads 14 may be added to prevent any scratching of the refrigerator surface.

Figure 4:
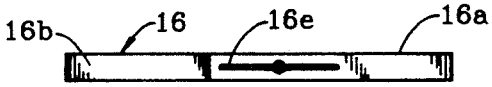
FIG. 4 shows a top elevational view of an alternate embodiment of the invention.
Figure 5:
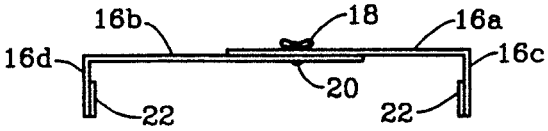
FIG. 5 shows a side elevational view of an alternate embodiment of the invention shown in FIG. 4.
Figure 6:
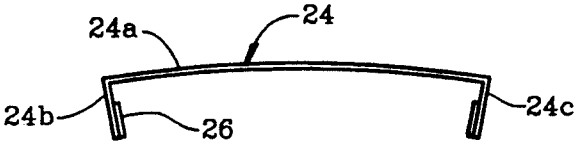
FIG. 6 shows yet another embodiment of the invention in a side elevational view.

FIG. 4 shows an alternate embodiment in which the bar 16 is divided into two separate overlapping sections **16*a* and 16*b* with section 16*a* including an upper slot and section 16*b* including an aperture which permit a wing nut and bolt to be disposed through the bar sections 16*a* and 16*b* so that the bar 16 may be adjusted in its overall length to accomodate any size refrigerator from back to front. Again, bar 16 may include pads 22** which engage the front and back of the surface of the refrigerator to prevent scratching or marring of the surface.

The bar as shown in all embodiments may be constructed of durable plastic, metal or any other desirable material, although plastic is preferred. The bar may also be coated about its surface with a TEFLON or rubber coating to prevent damage to the refrigerator surface.

In addition, as shown in FIG. 3, a magnet could be added in any portion of the bar to further couple or connect the bar to the refrigerator surface at any desired location. It is conceivable that with a magnet the bar as shown in FIGS. 2 or 3 could be cut in half and utilize only one flange with the magnet being anchored to the top surface of the metal refrigerator which would still prevent the door from being opened.

Figure 7:
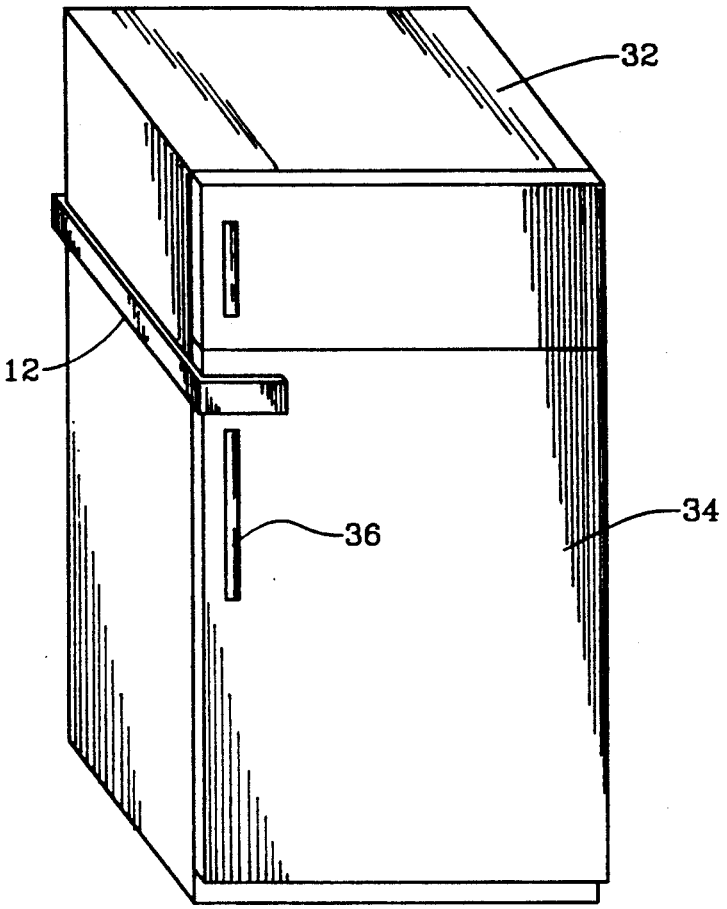
FIG. 7 shows a perspective view of the invention installed on a double door refrigerator.

FIG. 7 shows the bar 12 in use with a double door refrigerator. In this embodiment since the lower door is the one that the small child will access, the bar 12 is placed high enough above the floor, engaging the refrigerator door handle 36 and the back wall of the refrigerator and the front wall of door 34 to prevent the opening of door 34 by a child.

The primary purpose of the guard as shown in this invention is to prevent a small child who cannot physically reach very far above the floor while standing next to a refrigerator, from opening the refrigerator door and leaving it open so that the motor continuously runs causing damage to the refrigerator motor. Also it is a good idea not to have small children accessing the refrigerator unattended to obtain items in the refrigerator, since the child may break or spill items in trying to remove them from the refrigerator shelves.

Figure 8:
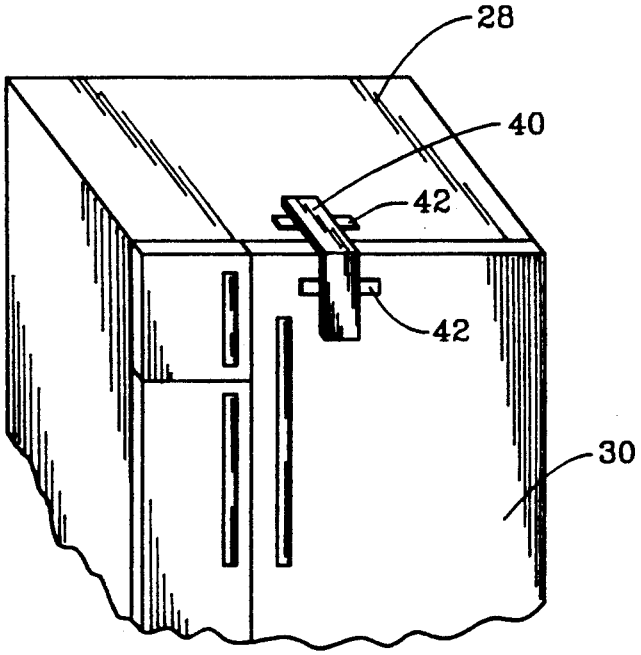
FIG. 8 shows an alternate embodiment in perspective of the invention.

Referring now to FIG. 8 an alternate embodiment of the invention is shown which includes replacement of the bar with a strap 40 that could have magnets attached at each end which can engage the metal of the refrigerator so that the strap 40 is disposed from the top of the refrigerator overlapping the front of the door with the magnets held in place which will prevent the door from being inadvertently opened. The straps could also include Velcro fasteners in lieu of magnets which could be used with an adhesively attached Velcro receiving end 42 atop the refrigerator and on the door so that the Velcro strap fasteners 42 engage on the door and the refrigerator top 28 which have been attached with a suitable adhesive, again preventing the door from being opened inadvertently by a child while still allowing an adult to easily detach the strap 40 from the Velcro connectors 42 on the refrigerator door to allow the door to be opened.

When considering the bar embodiment shown in FIGS. 1 through 7, it is realized that the front flange used with the refrigerator door can be longer to allow a person to easily grip the bar or the back flange could be smaller so as not to interfere with the mechanical works or grille work in the back of some refrigerators. It should also be realized that the bar as shown flat could be a tube instead of a flat bar.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. A door guard for securing a refrigerator door in a closed position to prevent a small child from opening the refrigerator door while at the same time not impeding adult access to the refrigerator consisting of:

a rigid bar, said bar having a middle portion and first and second flanges at each end substantially at ninety degrees to the middle portion of the bar, the distance between the flanges sized to engage the rear wall of a refrigerator and the front door surface of a refrigerator door and when engaged across the top of a refrigerator, preventing the door from being opened, said bar includes first and second sections and a means for adjustably locking the bar sections together at a predetermined position for allowing adjustment of the bar in length to accommodate refrigerators of different depths as measured between the front door surface and the rear wall surface of the refrigerator, said locking means includes a bolt and nut, said bar sections including first and second apertures for receiving said bolt which when said bolt is disposed through said first and second bar apertures and said nut is tightened, said first bar section is fastened relative to said second bar section.

2. A door guard for securing a refrigerator door in a closed position to prevent a small child from opening the refrigerator door while at the same time not impeding adult access to the refrigerator consisting of:

a rigid bar, said bar having a middle portion and first and second flanges at each end substantially at ninety degrees to the middle portion of the bar, the distance between the flanges sized to engage the rear wall of a refrigerator and the front door surface of a refrigerator door and when engaged across the top of a refrigerator, preventing the door from being opened, said bar end flanges are not parallel but are inclined at an acute angle relative to said middle portion and relative to each other inwardly, each relative to said bar at less than a ninety degree angle to provide a spring action between flanges when locking the bar over the refrigerator door and back wall portion.

3. A door guard for a refrigerator to prevent inadvertent opening of the door by a child comprising:

a flexible strap having a connecting means attached at each end and sized to fit between the top of the refrigerator and the front portion of the refrigerator door;

connecting means for attaching the ends of the strap to the top of the refrigerator and to the refrigerator door thereby preventing the door from being opened when both connecting means and the strap are connected together.

4. A door guard for a refrigerator to prevent inadvertent opening of the door by a child comprising:

a flexible strap having a connecting means attached to each end and sized to fit between the top of the refrigerator and the front portion of the refrigerator door;

connecting means for attaching the ends of the strap to the top of the refrigerator and to the refrigerator door thereby preventing the door from being opened when both connecting means and the strap are connected together, wherein the connecting means are magnets.

5. A refrigerator door guard as in claim 3, wherein the connecting means are a fabric fastener.

* * * * *